United States Patent [19]

Bonavia

[11] Patent Number: 5,030,883

[45] Date of Patent: Jul. 9, 1991

[54] CONSTANT SPARK RATE SYSTEM AND METHOD

[75] Inventor: Howard V. Bonavia, Tompkins, N.Y.

[73] Assignee: Simmonds Precision Products, Inc., Wilmington, Del.

[21] Appl. No.: 219,628

[22] Filed: Jul. 15, 1988

Related U.S. Application Data

[63] Continuation-in-part of Ser. No. 101,355, Sep. 25, 1987, abandoned.

[51] Int. Cl.[5] ..... H01J 19/78

[52] U.S. Cl. ..... 315/56; 315/55; 315/209 T; 315/219

[58] Field of Search ..... 315/55, 56, 57, 58, 315/59, 60, 209 T, 219, DIG. 5, DIG. 7, DIG. 4

[56] References Cited

U.S. PATENT DOCUMENTS

| | | | |
|---|---|---|---|
| 3,300,682 | 1/1967 | Frungel et al. | 315/56 |
| 3,531,737 | 9/1970 | Thakore | 315/209 |
| 3,818,253 | 6/1974 | Chafer et al. | 315/58 |
| 3,835,350 | 9/1974 | Thakore | 315/209 |
| 3,869,645 | 3/1975 | Collins | 315/209 T |
| 4,019,484 | 4/1977 | Mori | 315/209 T |
| 4,192,275 | 3/1980 | Weydemuller | 315/209 T |
| 4,202,304 | 5/1980 | Jundt et al. | 315/209 T |
| 4,202,305 | 5/1980 | Wolf | 315/209 |
| 4,275,702 | 6/1981 | Jundt et al. | 315/209 T |
| 4,355,263 | 10/1982 | Bohrlen | 315/209 T |
| 4,382,431 | 5/1983 | Bodig et al. | 315/209 T |
| 4,461,265 | 7/1984 | Sugiura | 315/209 T |
| 4,461,979 | 7/1984 | Jeenicke et al. | 315/209 T |
| 4,631,451 | 12/1986 | Anderson et al. | 315/58 |
| 4,682,081 | 7/1987 | Sikora | 315/219 |
| 4,705,013 | 11/1987 | Minks | 315/209 T |

*Primary Examiner*—Michael Razavi

*Attorney, Agent, or Firm*—Dale R. Lovercheck

[57] ABSTRACT

A system and method for providing a constant rate of sparking in the spark gap of an internal combustion engine by supplying constant power to the capacitor which discharges through the spark gap. The capacitor receives current from the secondary coil of a transformer. The system uses a multivibrator to control current flow through the primary circuit of a transformer. The multivibrator is controlled by a comparator which compares an integrated transformer feedback signal to a temperature compensated reference voltage. In any two equal time periods, substantially the same amount of current flows to the capacitor from the secondary of the transformers. Substantially the same number of sparks are discharged through a spark gap during equal time periods.

19 Claims, 5 Drawing Sheets

CONSTANT SPARK RATE SYSTEM AND METHOD

This is a continuation-in-part of U.S. Pat. application Ser. No. 101,355 filed Sept. 25, 1987 now abandoned.

The invention relates to a system for providing a constant spark rate. More particularly, the invention provides a multivibrator to control current flow in a transformer used to charge a capacitor which is discharged through a spark gap at a constant spark rate. This constant spark rate system is useful in aircraft exciters.

In accordance with the invention, constant power is supplied to a transformer, which provides a constant rate of high voltage energy to a storage capacitor. This high voltage energy is discharged from the capacitor in substantially equal amounts at substantially equal time intervals to provide a constant spark rate in the spark gap (or discharger).

The constant power supplied to the transformer is regulated to within preset limits by a multivibrator through feedback control. The multivibrator is controlled by a comparator which compares an integrated transformer feedback signal to a temperature compensated reference voltage. The multivibrator alternately opens and closes the primary circuit to provide a sequence of equal changes in current in the transformer.

Sikora in U.S. Pat. No. 4,682,081; Speranza in U.S. Pat. No. 1,617,620; Moberg in U.S. Pat. No. 4,391,719; and Bete in U.S. Pat. No. 4,378,585 each disclose circuits having a transformer with a feedback voltage. However, they provide positive and negative base drive only. These windings are not used to sense primary current. Bete in U.S. Pat. No. 4,378,585; Huntzinger in U.S. Pat. No. 3,357,116; and Jundt in U.S. Pat. Nos. 1,275,702, 4,265,201 and 4,202,304 use integration to control output parameters. However, they do not provide constant spark power as the integration parameter is not the voltage across the power transformer as is provided by the invention described herein.

Increases in the spark rate above desirable level shortens the lifetime of the igniter plug, increases the size of the exciter enclosure to accommodate increased heating, and increases the electromagnetic interference (EMI) filter requirements due to increased input currents.

It is an obJect of the invention that the spark rate of an aircraft ignition system remain constant as the dc input voltage to the exciter varies for example from 10 to 30 volts.

Flyback converters having a circuit of the type shown in FIG. 1 are commonly used in aircraft exciters. FIG. 1A shows the magnitude of primary coil current $i_p$ and secondary coil current $i_s$ over time in the transformer shown in FIG. 1. The spark rate (SR) produced by the converter shown in FIG. 1 is given by Equation I:

$$SR = nI_pV_{SS}/2J_c[1+n(2aV_{SS}/V_{BR})] \quad (I)$$

Wherein n is circuit efficiency (power out/power in); $I_P$ is peak primary current of transformer; $V_{SS}$ is dc input voltage; $V_{BR}$ is breakdown voltage of discharge tube; a is secondary to primary turns ratio of the transformer; and $J_C$ is energy stored in capacitor $C_S$, which is equal to one-half of the capacitance of capacitor $C_s$ multiplied by the discharge tube breakdown voltage $V_{BR}^2$.

The converter circuit shown in FIG. 2 uses a second regulator transistor, QII to maintain constant base current to the switching transistor; QI, which holds peak primary current, $I_p$ constant, over the range of input voltage. A three-to-one change in $V_{SS}$ produces only a three-to-one spark rate change as shown by equation I.

The spark rate of the regulated circuit changes far less than that of the single transistor circuit but is still far from constant. A disadvantage common to both circuits (shown in FIGS. 1 and 2) is that spark rate is dependent on the gain of the transistors. Since gain varies widely from one transistor to the other, base current limiting resistors must be selected individually for each transistor on the production line. Additionally, the transistor gain degradation caused by neutron bombardment will cause a large reduction in spark rate of the prior art circuits. The system of the present invention maintains a substantially constant spark rate during gain degradation caused by neutron bombardment.

SUMMARY OF THE INVENTION

A system and method for providing a constant rate of sparking in the spark gap of an internal combustion engine by supplying constant power to the capacitor which discharges through the spark gap. The capacitor receives current from the secondary coil of a transformer. The system uses a multivibrator to control current flow through the primary circuit of a transformer. The multivibrator is controlled by a comparator which compares an integrated transformer feedback signal to a temperature compensated reference voltage. In any two equal time periods, substantially the same amount of current flows to the capacitor from the secondary of the transformers. Substantially the same number of sparks are discharged through a spark gap during the equal time periods.

DETAILED DESCRIPTION OF THE INVENTION

Figure 1:
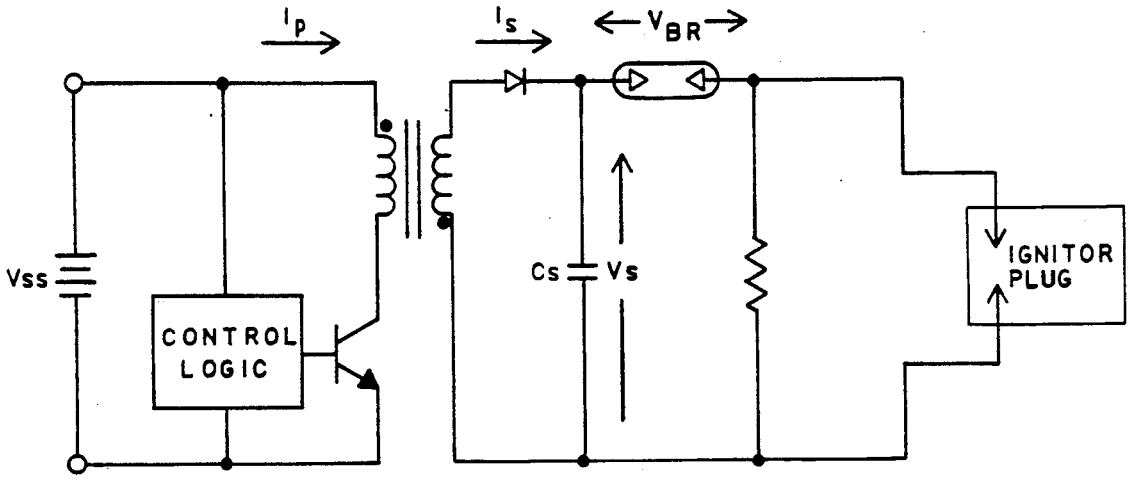
FIG. 1 is a schematic representation of a flyback converter commonly used in aircraft exciters.
Figure 1A:
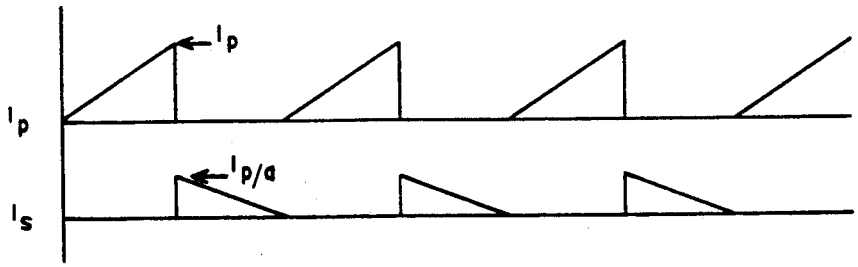
FIG. 1A shows the magnitude of primary coil current ip and second coil current is over time in the transformer shown in FIG. 1.
Figure 2:
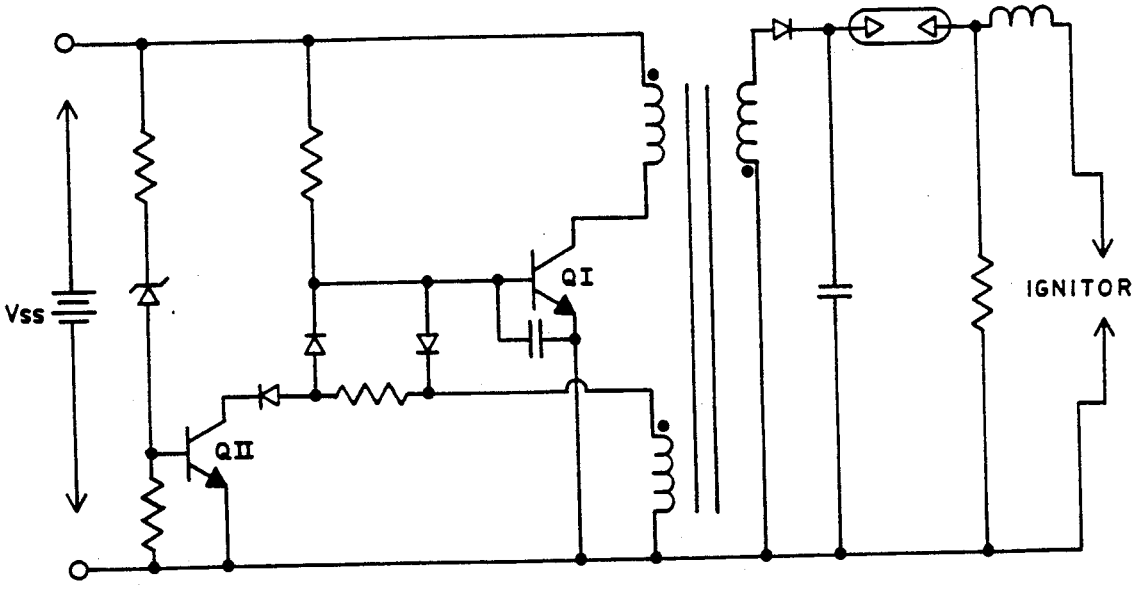
FIG. 2 is a schematic representation of a prior converter circuit with a regulator transistor.
Figure 3:
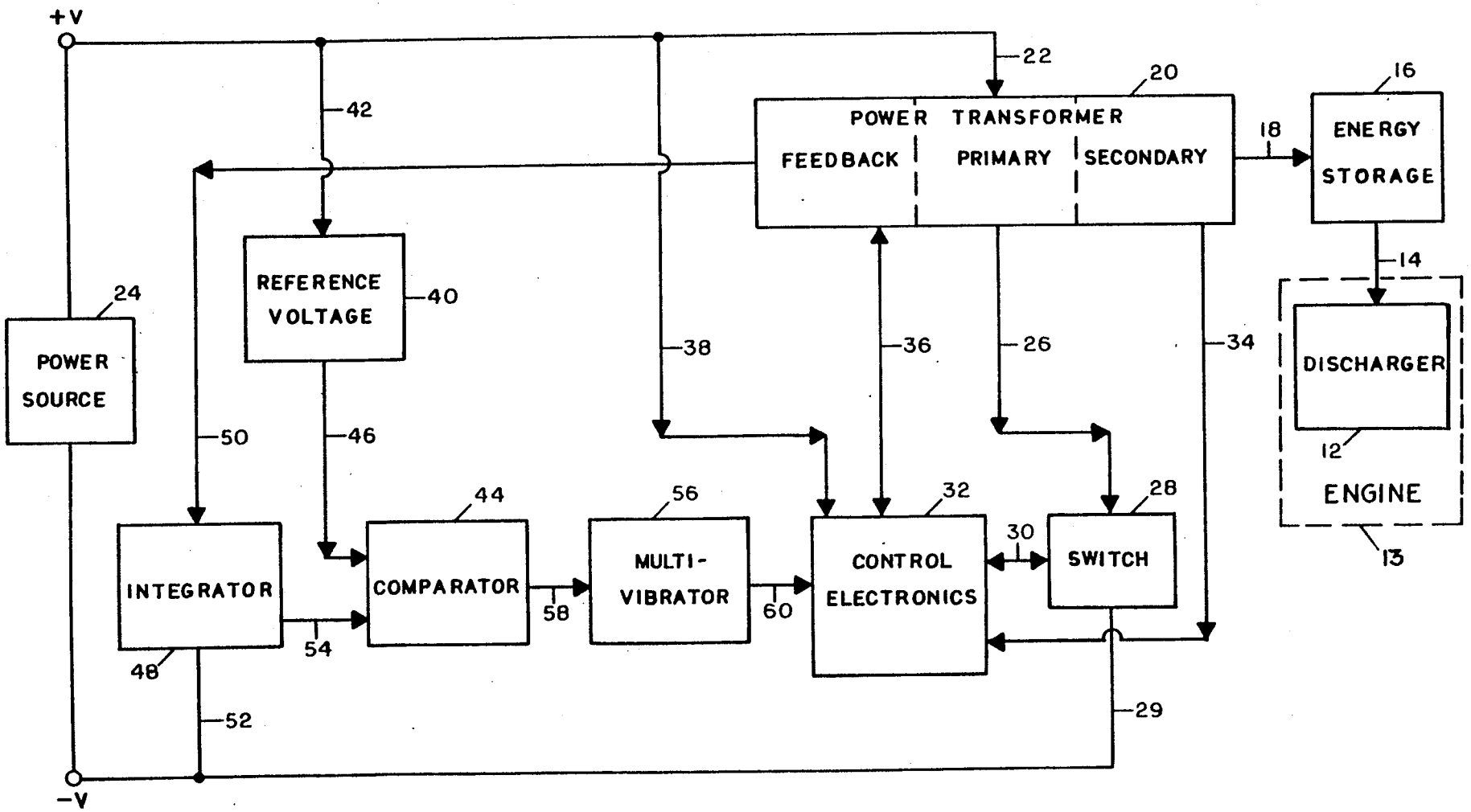
FIG. 3 is a generalized schematic representation of a transformer peak primary current control system in accordance with the invention.

With more particular reference to FIG. 3, a constant spark system 10 in accordance with the invention is shown. The discharger 12 in internal combusion engine 13 is connected by line 14 to energy storage 16, which is connected to the secondary of power transformer 20. Transformer 20 receives current through line 22 from power source 24. The primary coil of transformer 20 is connected by line 26 to switch 28 connected by line 29 to power source 24. Switch 28 is connected by line 30 to control electronics 32, which is connected by line 34 to the secondary coil of transformer 20. Control electronics 32 is connected by line 36 to transformer 20 to receive feedback. Power source 24 is connected by line 38 to control electronics 32.

Voltage reference 40 is connected to power source 24 through line 42, and to comparator 44 through line 46. Integrator 48 is connected to power transformer 20 through line 50, to power source 24 through line 52 and to comparator 44 through line 51. Comparator 44 is connected to multivibrator 56 through line 58. Single-shot (monostable) multivibrator (or Schmitt trigger) 56 is connected to control electronics 32 through line 60.

The system of the invention provides spark to internal combustion engine ignition plugs at a constant rate over a wide range of temperatures and supply voltages. To provide a constant spark rate over variations in temperature and voltage, a temperature compensated voltage reference 40 provides a signal to comparator 44. The constant voltage drop across the Zener diode Z1 provides a constant voltage reference to the emitter of transistor Q1 of the comparator via diodes D2, D3 and D4. The comparator compares the constant reference voltage from reference voltage 40 to the integrator voltage from integrator 48. This integrator voltage is the sum of the voltage over time from the feedback winding FB of the transformer 20.

By compensating for variations in the temperature and voltage from the voltage source, the comparator provides a constant voltage to the multivibrator which provides continuous sequence of constant voltage pulses to the control electronics, which regulates to a constant flow the current in the secondary of the transformer and the current through the primary of the transformer through switch 28. The constant flow of current in the secondary provides constant rate of energy storage in storage 16, which provides a constant rate of discharge in discharger 12.

Figure 4:
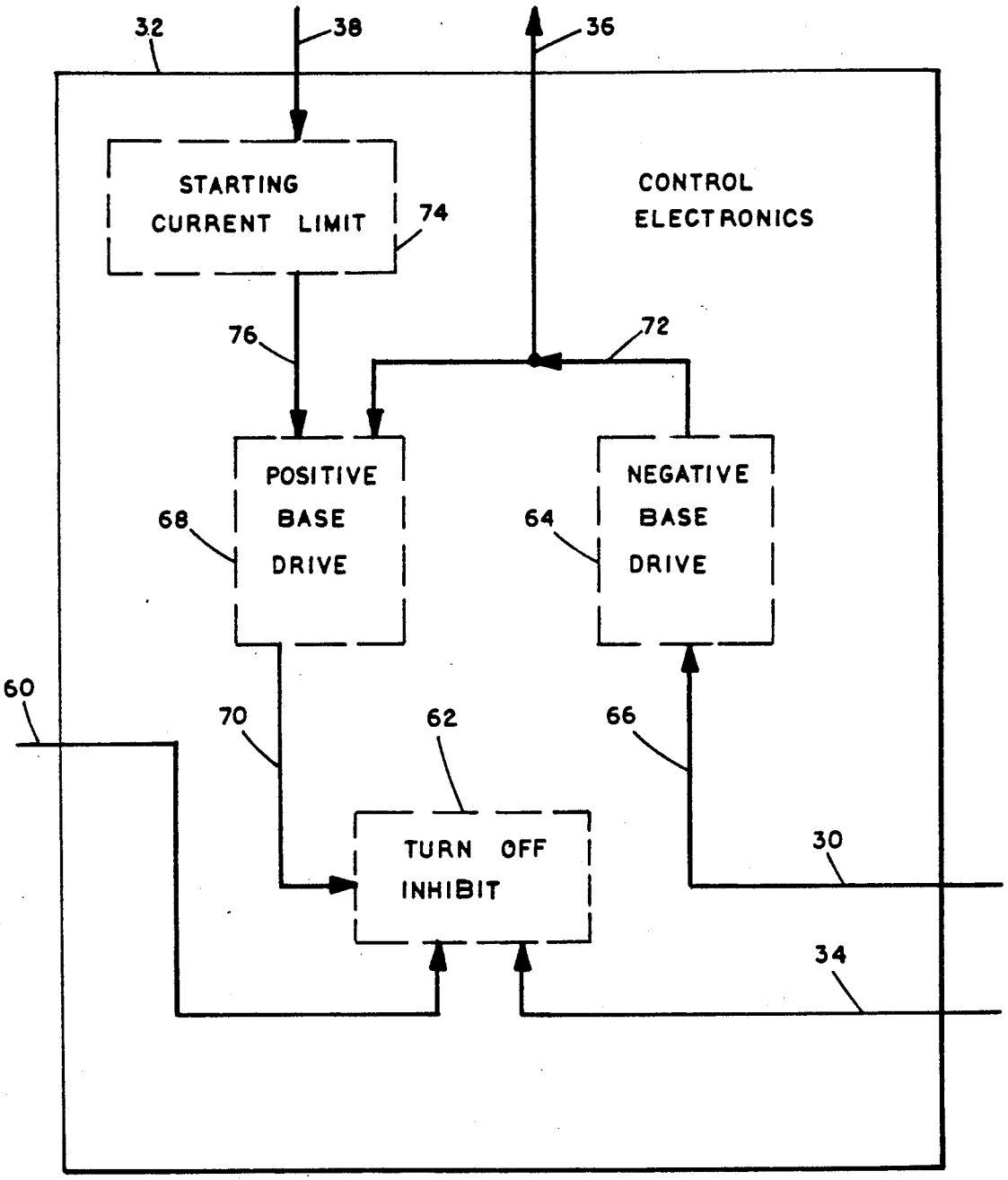
FIG. 4 is a generalized schematic representation of the control electronics shown in FIG. 3.

With more particular reference to FIG. 4, a preferred embodiment of a control circuit 32 is shown for use in accordance with the invention as shown in FIG. 3.

Turn off inhibit 62 is connected to lines 30, 34 and 60 which are connected as shown in FIG. 3 as described above. Inhibit 62 is connected to Negative base drive 64 through line 66 and to positive base drive 68 through line 70. Negative base drive 61 is connected to positive base drive 68 by line 72. Line 72 is connected to line 36 which is connected as shown in FIG. 3 as described above. Positive base drive 68 is connected to starting current limit 74 through line 76. Starting current limit 74 is connected to line 38 which is connected as shown in FIG. 3 as described above.

The embodiment of the invention shown in FIGS. 3--5 provides constant spark rate circuit that is independent of transistor gain. The spark rate provided remains constant over the range of input voltage and the value of circuit components can be fixed independently of transistor gain.

Equation II is obtained by rearranging Equation I as follows:

$$I_p = 2SRJc[1/nV_{SS} + 2a/V_{BR}] \quad (II)$$

Equation II shows that transformer primary current $I_p$ is directly proportional to spark rate SR and varies inversely with input voltage $V_{SS}$. For a fixed spark rate, SR, values for transformer peak primary current $I_p$ can be calculated at the extremes of input voltage, $V_{SS}$.

Figure 5:
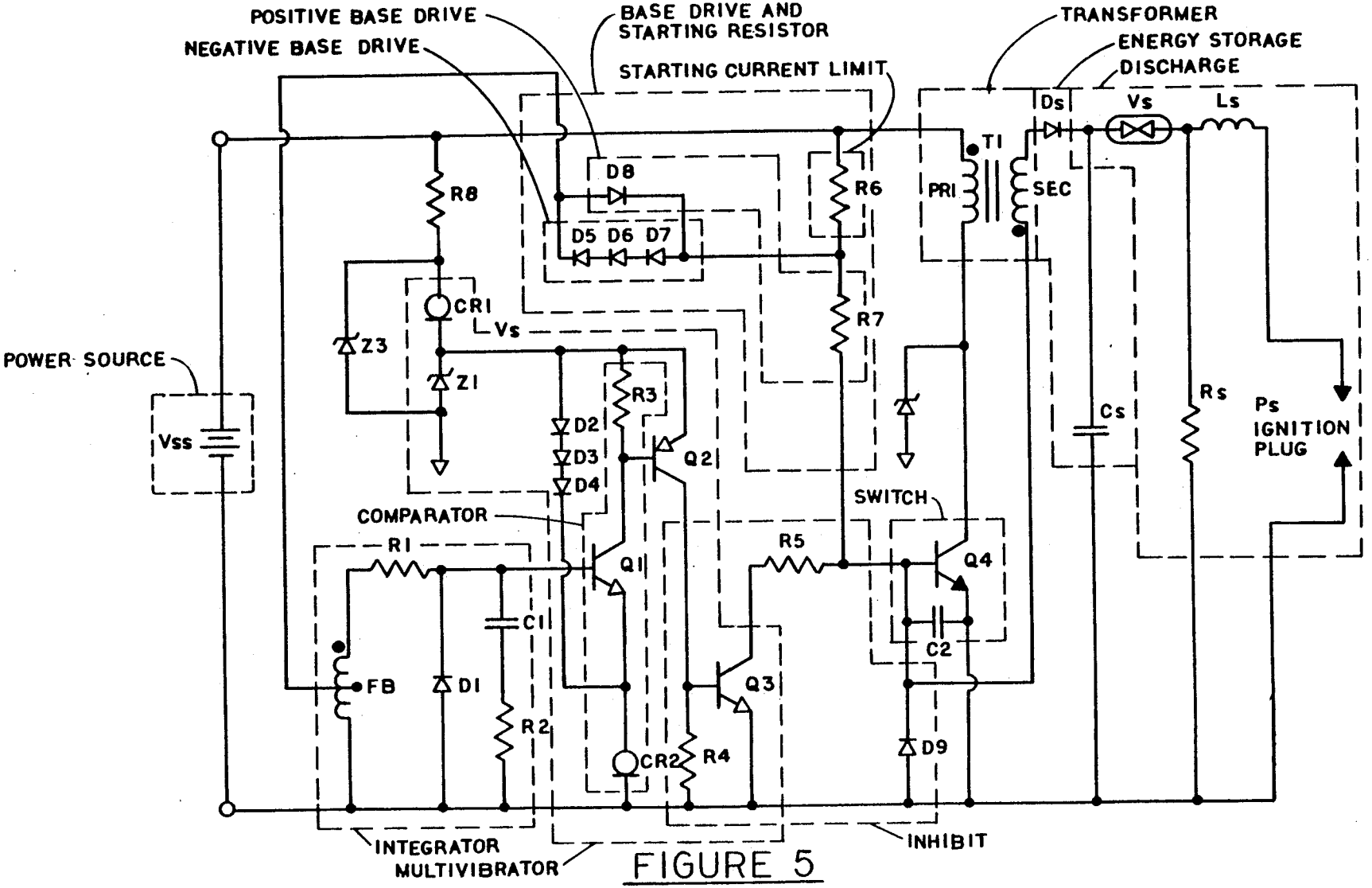
FIG. 5 is a detailed schematic representation of a transformer peak primary current control circuit in accordance with the invention.

In accordance with a preferred embodiment of the invention, a circuit that will control transformer peak primary current $I_P$ to these levels at the corresponding limits of input voltage is shown in FIG. 5. The circuit includes a regulated power supply and temperature compensated voltage reference, a resistance and capacitance (RC) integrator, a voltage comparator/Schmidt trigger, an output switch driver with inhibit and an output switch and power transformer. This circuit makes use of the relationship that transformer primary current ip is equivalent to the time integral of primary voltage divided by transformer primary inductance.

With the circuit in the quiescent state, output switch, transistor Q4, is off and the windings of T1 are without current or voltage. In a preferred embodiment of the invention, the starting current from the supply is limited by resistor R6 and flows through D5, D6 and D7 creating a 1.5 volt bias that charges capacitor C2 through resistor R7. As the voltage on capacitor C2 rises above the base cut in voltage of transistor Q4, then transistor Q4 will begin to conduct current. If the rate of change of voltage over time (dv/dt) on capacitor C2 multiplied by the transconductance of transistor Q4 is greater than the rate of current rise in the primary of transformer T1, then Q4 will saturate, dropping the supply voltage across the primary (PRI) of transformer T1. Voltage polarity of transformer T1 windings becomes positive meaning the dotted ends (as shown in FIG. 5) are positive with respect to the undotted ends. Current into the secondary coil SEC of the transformer is blocked by rectifier diode, $D_S$.

Voltage at the center tap of the feedback winding FB forces current through diode D8 and base limiting resistor R7 into the base of transistor Q4 reinforcing the starting current already flowing. Resistor R7 is chosen to provide sufficient base current at the lowest supply voltage to a transistor, Q4, with the lowest allowable gain. Preferably, transistor $Q_4$ is a compound transistor such as a Darlington pair. Voltage at the top of the feedback winding FB forces a current through resistor R1 that is proportional to the transformer primary voltage which is integrated on capacitor C1. The resulting capacitor voltage is proportional to the transformer primary current $I_p$. This voltage appearing at the base of comparator transistor, Q1, crosses the threshold when $I_p$ has risen to the level, transformer peak primary current $I_p$, necessary to produce the required spark rate. The voltage drop across resistor R2 adds an offset to the comparator input that is proportional to the voltage $V_{SS}$ from the power source. This decreases the level of transformer peak primary current $I_p$ as the voltage $V_{SS}$ increases. In a preferred embodiment of the invention, resistor R1 is set to provide the specified spark rate at 14 volts and resistor R2 is set to maintain the spark rate at 30 volts.

As the comparator transistor Q1 threshold is crossed in the positive direction, bipolar transistors Q1, Q2 and Q3 turn on creating a current drain on the power source, which in a preferred embodiment of the invention is limited to three milliamperes by current regulator diode CR1 which holds current constant. Voltage, $V_z$, drops to within a half volt of the voltage on capacitor C1 and remains there until capacitor C1 has discharged below the voltage $V_{BE}$ cut in of transistor Q1. The collapse of voltage, $V_z$, cuts off current through diode string, D2, D3 and D4, which changes the reference voltage at the emitter of transistor Q1 from a voltage source to a current source and finally a resistance as C1 is discharged through R1 after the voltage reverses on the feedback winding occasioned by the turn off of transistor Q4. When the voltage on capacitor C1 falls below the base emitter voltage $V_{BE}$ cut in of transistor Q1; then transistors Q1, Q2 and Q3 turn off allowing the voltage, $V_{,z}$ to rise to 6.2 volts regulated by Zener diode Z1. Current again flows through diodes D2, D3 and D4 reestablishing the reference voltage at the emitter of transmitter Q1. The feedback winding completes the discharge of capacitor C1, and diode, D1, clamps the voltage at C1 to one diode drop below the common. During the short interval that transistors Q1, Q2 and Q3 are in conduction, most of the three milliamperes limited by current regulator diode CR1 flow through the collector of transistor Q2, and the base of transistor Q3. The collector of transistor Q3 clamps the base of transistor Q1 to common through resistor R5 turning transistor Q4 off which interrupts transformer primary (PRI) current. With primary current interrupted, the magnetic field of transformer, T1, begins collapsing and the voltage at the dotted end (as shown in FIG. 5) of each winding becomes negative with respect to the undotted end. The secondary winding begins to conduct around the path consisting of diode DS, capacitor CS and diode D9; transferring the stored magnetic energy of transformer T1 into capacitor, $C_S$.

Transistor Q4 cannot begin conduction until secondary current flowing through diode D9 falls below the level of starting current established by the bias voltage across diodes D5, D6 and D7 and limited by resistor R7. When the transfer of energy from transformer, T1, to the storage capacitor, $C_S$, has been completed the transformer winding voltages and currents return to zero and starting current from the supply initiates the next cycle. After a sufficient number of cycles, capacitor $C_S$ charges to the breakdown voltage of discharge tube, $V_S$. Capacitor $C_S$ then discharges through discharge tube $V_S$, inductor $L_S$ and into igniter plug, $P_S$, creating a spark at the plug gap. The number of cycles (transferring electrical charge to the capacitor, $C_S$) is independent of transistor gain. For a substantially constant input voltage $V_{SS}$ the sparks per unit of time is substantially constant.

As seen from the preferred embodiment of the invention shown in FIG. 5, the multivibrator shares the components transistor Q1, current regulator diode CR2 and resistor R3 of the comparator. Also, the components which perform the temperature stable voltage reference function, namely current regulator diodes CR1, and CR2, Zener diode Z1, and diodes D2, D3, and D4 are shared by the multivibrator.

A preferred embodiment of the invention provides a method for providing a constant rate of sparking in a spark gap in an internal combustion engine. Substantially constant power is supplied to capacitor $C_s$ which discharges through a spark gap of ignition plug $P_s$ in internal combustion engine 13. This power is transferred from the primary coil to the secondary coil to maintain the substantially constant rate of sparking in the spark gap.

While the invention has been described in connection with what is presently considered to be the most practical and preferred embodiments, it is to be understood that this invention is not limited to the disclosed embodiment, but, on the contrary, is intended to cover various modifications and equivalent arrangements included within the spirit and scope of the appended claims. It is to be understood that all such equivalent structures are to be included within the scope of the following claims:

What is claimed is:

1. A system for providing a constant spark, comprising:

a power supply, a monostable multivibrator, an integrator, a transformer, a comparator means, a temperature compensated reference voltage means and a discharger, said transformer comprising a primary coil, a secondary coil and a feedback coil, said power supply being connected to said multivibrator, said multivibrator being connected to said primary coil of said transformer, said secondary coil of said transformer being connected to said discharger, said integrator being connected to said feedback coil of said transformer, said comparator being connected to said feedback coil of said transformer, said comparator being connected to said temperature compensated reference voltage means, said multivibrator being connected to said comparator, said comparator being adapted to compare an integrated signal from said feedback coil of said transformer to a signal from said temperature compensated reference voltage means.

2. The system of claim 1 wherein said system further comprises a driver, said driver being connected to said multivibrator.

3. The system of claim 1 wherein said integrator is a voltage integrator, said voltage integrator being connected to said multivibrator.

4. The system of claim 2 wherein said integrator is a voltage integrator, said voltage integrator being connected to said multivibrator.

5. The system of claim 3 wherein said voltage integrator is connected to said power supply.

6. The system of claim 3 wherein said voltage reference is connected to said power supply and to said integrator.

7. The system of claim 1 wherein said multivibrator is a monostable multivibrator.

8. The system of claim 1 further comprising energy storage, said energy storage being connected to said discharger and to said transformer.

9. The system of claim 1 further comprising a switch, said switch being connected to said transformer and to said multivibrator.

10. The system of claim 9 further comprising control means, said control being connected to said multivibrator and to said switch.

11. The system of claim 10 wherein said control means comprises current limit means and turn-off inhibit means.

12. The system of claim 10 wherein said control means comprises positive base drive and negative base drive.

13. A system for providing a constant spark, comprising:

a power supply, a voltage integrator means, a transformer, and a spark gap;

said transformer having a primary coil, secondary coil and a feedback coil, said power supply being connected to said primary coil of said transformer, said power supply being connected to said voltage integrator, said voltage integrator means being connected to said feedback coil of said transformer, said secondary coil of said transformer being connected to said spark gap, said voltage integrator means being adapted to maintain substantially constant current to said secondary coil of said transformer.

14. The system of claim 13 wherein said integrator comprises a resistor and capacitor.

15. A method for providing a constant rate of sparking in a spark gap in an internal combustion engine, comprising:

a) providing a transformer a capacitor, a spark gap, an internal combustion engine, and electrical power source, an integrator, a voltage reference and a comparator, said transformer having a primary coil, a secondary coil and a feedback coil, said power source being connected to said primary coil, said secondary coil being connected to said capacitor, said capacitor being connected to said spark gap, said spark gap being positioned within said internal combustion engine;

said feedback coil being connected to said integrator, said integrator being connected to said comparator, said comparator being connected to said primary coil, and to said voltage reference, said voltage reference being connected to said power source.

b) supplying substantially constant current power to said capacitor from said secondary coil of said transformer, whereby said capacitor discharges through said spark gap in said internal combustion engine at a substantially constant rate, and power transferred from said primary coil to said secondary coil maintains a substantially constant rate of sparking in said spark gap.

16. The method of claim 15 further comprising providing a monostable multivibrator, said multivibrator being connected to said comparator and to said primary coil.

17. The method of claim 16 further comprising providing control electronics, said control electronics being connected to said multivibrator, to said primary coil, to said secondary coil, to said feedback coil, and to said power source.

18. The method of claim 17 further comprising providing a switch, said switch being connected to said primary coil, to said control electronics, and to said power source.

19. The method of claim 18 wherein said multivibrator comprises at least two transistors.

* * * * *